US006158062A

United States Patent [19]

Vespo

[11] Patent Number: 6,158,062

[45] Date of Patent: Dec. 12, 2000

[54] POOL DECKING SYSTEM

[76] Inventor: Jerry W. Vespo, 5165 Osage Ave., Porter County, Portage, Ind. 46368

[21] Appl. No.: 09/337,933

[22] Filed: Jun. 22, 1999

Related U.S. Application Data

[60] Provisional application No. 60/090,089, Jun. 20, 1998.

[51] Int. Cl.[7] ..... E04H 4/00

[52] U.S. Cl. ..... 4/496; 4/503; 4/506

[58] Field of Search ..... 4/496, 503, 506; 52/3, 169.7, 169.8, 273, 718.04

[56] References Cited

U.S. PATENT DOCUMENTS

| | | | |
|---|---|---|---|
| 3,347,006 | 10/1967 | Fox . | |
| 3,416,165 | 12/1968 | Pereira . | |
| 3,840,908 | 10/1974 | Greene . | |
| 3,955,220 | 5/1976 | Kessler . | |
| 3,959,830 | 6/1976 | Van Den Brook . | |
| 3,986,310 | 10/1976 | Van Den Broek . | |
| 4,120,126 | 10/1978 | West | 52/169.7 |
| 4,980,934 | 1/1991 | Dahowski et al. | 4/506 |

*Primary Examiner*—Henry J. Recla
*Assistant Examiner*—Khoa D. Huynh
*Attorney, Agent, or Firm*—Gary M. Hartman; Domenica N. S. Hartman

[57] ABSTRACT

An aboveground pool decking system that entails a platform that mounts to and over the conventional top rail of an aboveground pool, creating a smooth, level and gap-free transition from the deck to the edge of the pool. The platform includes an extension that fills the gap that is required between the top rail and deck to allow for maintenance and repairs to the pool and installation of a pool cover. With the extension, the pool deck is permitted to abut against the outer edge of the platform. The platform is configured to be securely attached to and stable on the top rail, yet easily removed to re-expose the gap between the rail and deck for repairs, maintenance and installation/removal of a pool cover. Various embodiments are possible for the platform that further promote the aesthetic and functional advantages of the invention.

20 Claims, 4 Drawing Sheets

POOL DECKING SYSTEM

CROSS REFERENCE TO RELATED APPLICATIONS

This application claims the benefit of U.S. Provisional Application No. 60/090,089, filed Jun. 20, 1998.

BACKGROUND OF THE INVENTION

1. Field of the Invention

The present invention generally relates to swimming pools. More particularly, this invention relates to a decking system for an aboveground swimming pool that provides a more cosmetically pleasing appearance while also providing for necessary access to the pool structure for proper maintenance and repair of the pool.

2. Description of the Prior Art

As shown in FIG. 1, aboveground pools typically have a perimeter support structure that includes a wall 10 (typically nonrigid), upright vertical supports 12 outside the wall 10 and spaced around the perimeter of the pool, a top rail 14 attached to the vertical supports 12 and overlying the wall 10, and a pool liner 16. Plastic coping 11 and a stabilizer rail 13 aid in securing the liner 16 to the pool wall 10. Adjacent sections of top rails 14 typically meet over a vertical support 12, and are hidden by an end cap 18. The functional and aesthetic qualities of aboveground pools are greatly enhanced if a deck is built around its perimeter. However, as seen in the top drawing of FIG. 2, a large access gap 20, typically on the order of at least about one inch, is required between the deck 22 and rail 14 in order to install and remove a pool cover and perform other maintenance and repairs on the pool and pool liner 16. This gap 20 also poses a hazard, such as splinters from the ends of the deck planks and entrapment within the gap 20, especially for young children. Any attempt to reduce the gap 20 makes maintenance, repair and winterizing of the pool more difficult. For example, a large gap 20 is preferred when installing a pool cover (not shown), because the cover must be placed over the top rail 14 and then under the outer edge of the rail 14, i.e., through the gap 20, then secured with a cable or rope along the outer surface of the wall 10. An alternative, shown in FIG. 3, is to extend an edge of the deck 22 over the top rail 14. While hiding the undesirable gap 20, the deck 22 is prone to warpage and removal of the rail 14 is very difficult.

From the above, it can be seen that it would be desirable to provide an improved decking system for an aboveground pool that eliminates the gap 20 between the top rail 14 and deck 22 while permitting ease of maintenance, repair and installation of a pool cover.

SUMMARY OF THE INVENTION

According to the present invention, there is provided an aboveground pool decking system that entails a platform that mounts to and over the conventional top rail of an aboveground pool, creating a smooth, level and gap-free transition from the deck to the edge of the pool. The platform includes an extension that fills the gap that is required between the top rail and deck to allow for maintenance and repairs to the pool and installation of a pool cover. With the extension, the pool deck is permitted to abut against the outer edge of the platform. The platform is configured to be securely attached to and stable on the top rail, yet easily removed to re-expose the gap between the rail and deck for repairs, maintenance and installation/removal of a pool cover. Various embodiments are possible for the platform that further promote the aesthetic and functional advantages of the invention.

Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 4:
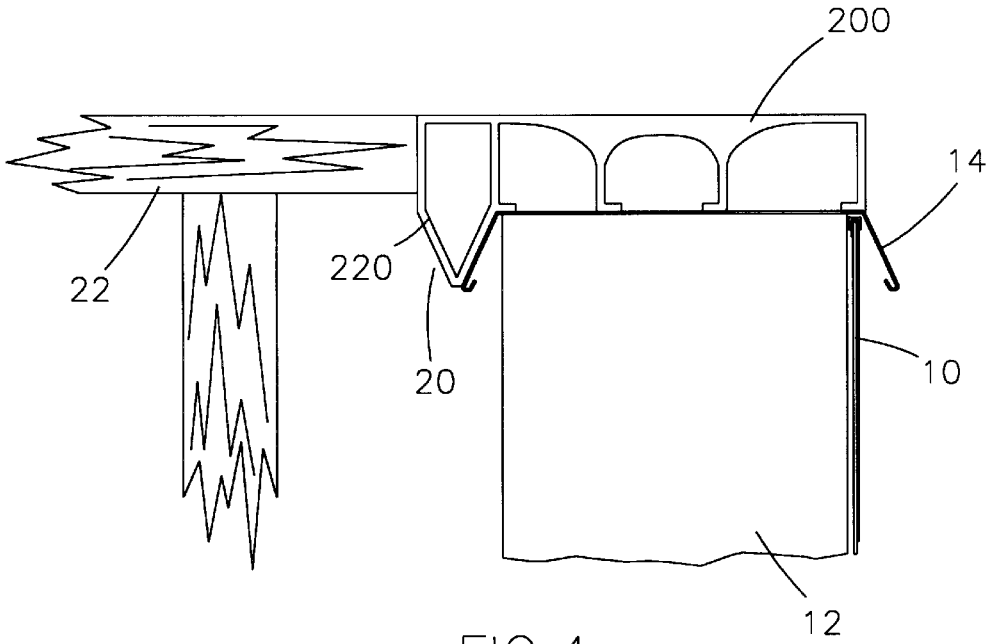
FIG. 4 is a cross-sectional view of a pool decking system in accordance with this invention.
Figure 5:
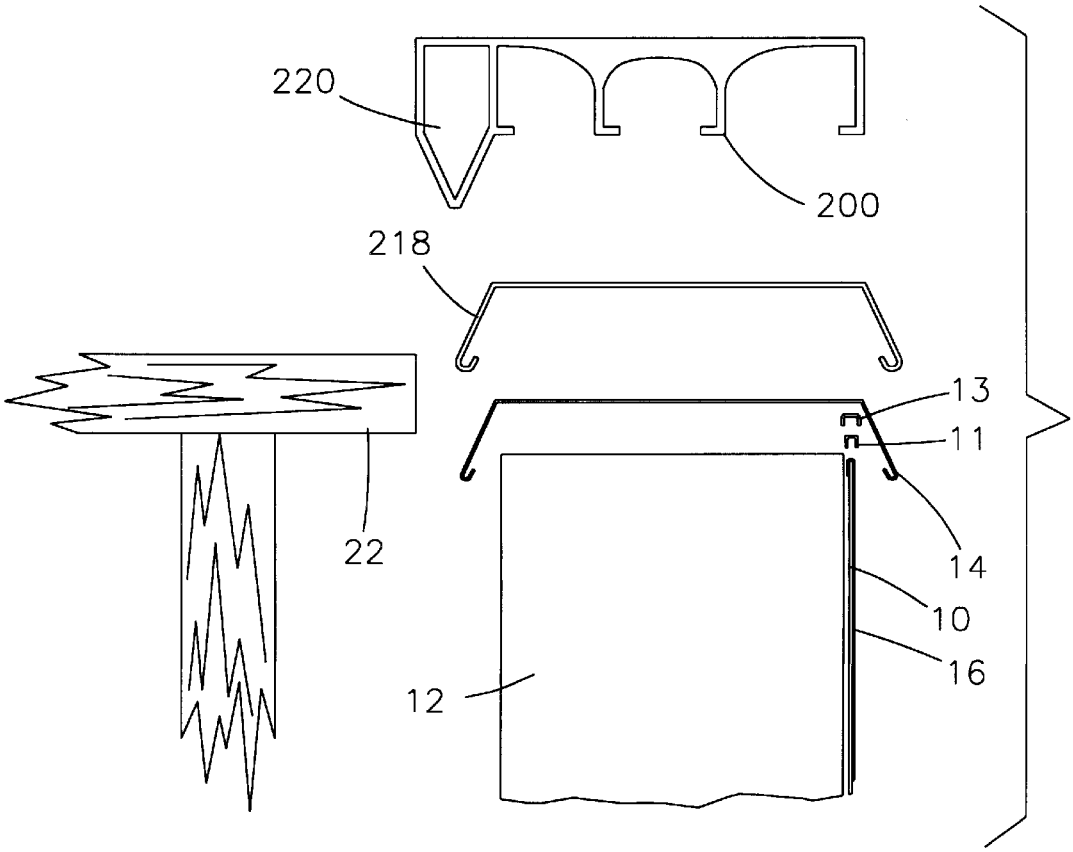
FIG. 5 is an exploded cross-sectional view of the pool decking system of FIG. 4.

FIGS. 4 and 5 illustrate preferred features of a pool decking system in accordance with this invention. Particularly, a platform 200 is shown as including an extension 220 that extends into and fills a gap 20 between the top rail 14 of an aboveground pool and a deck 22 surrounding the pool. FIG. 4 shows the decking system assembled, while FIG. 5 is an exploded view and shows a plastic coping 11 and stabilizer rail 13 that aids in securing a liner 16 to a pool wall 10. Also shown in FIG. 5 is an end cap 218 that covers the end of a vertical (upright) support 12 of the pool.

Figure 1:
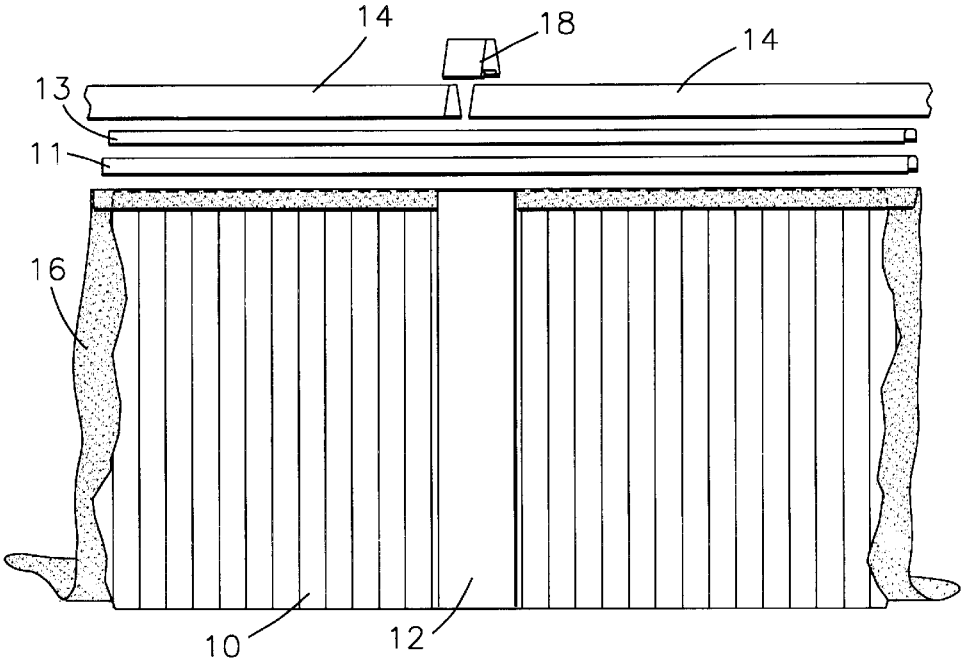
FIG. 1 PRIOR ART
FIG. 1 is a partially-exploded side view of the interior wall and decking components of an aboveground pool in accordance with the prior art.
Figure 2:
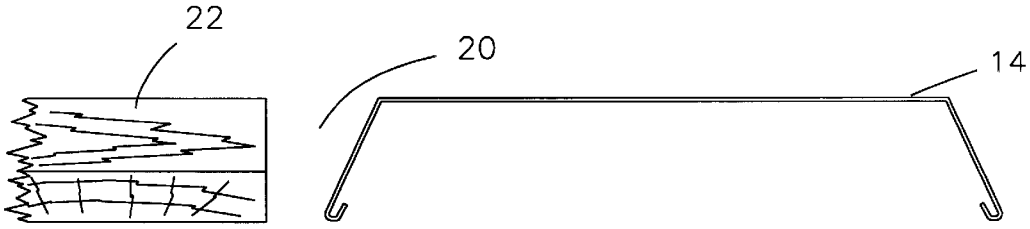
FIG. 2 PRIOR ART
FIGS. 2 and 3 are cross-sectional views of pool decking systems in accordance with the prior art.
Figure 3:
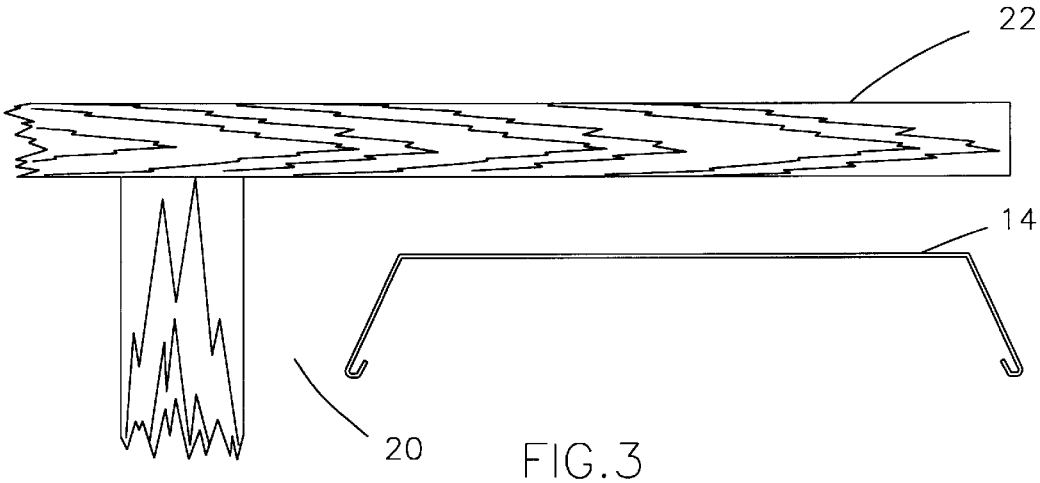
FIG. 3 PRIOR ART
Figure 6:
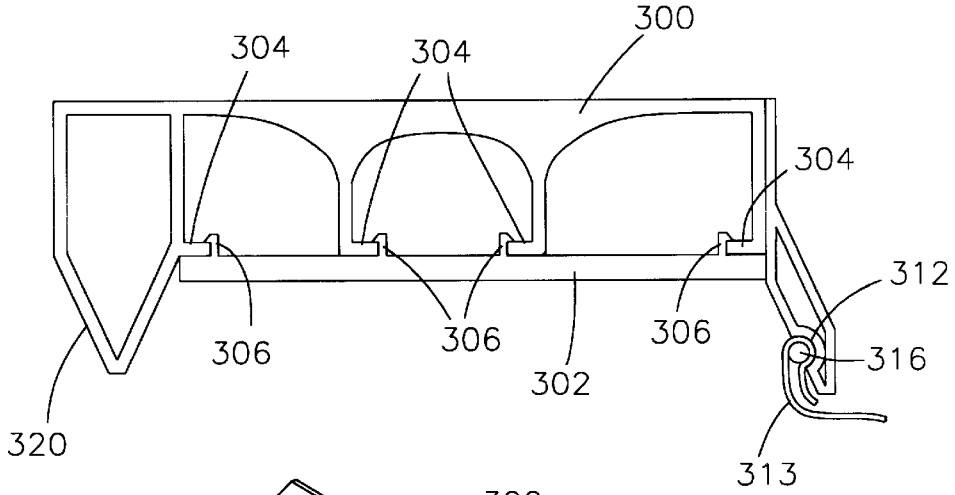
FIG. 6 is a cross-sectional view of a pool decking system in accordance with a preferred embodiment of this invention.
Figure 7:
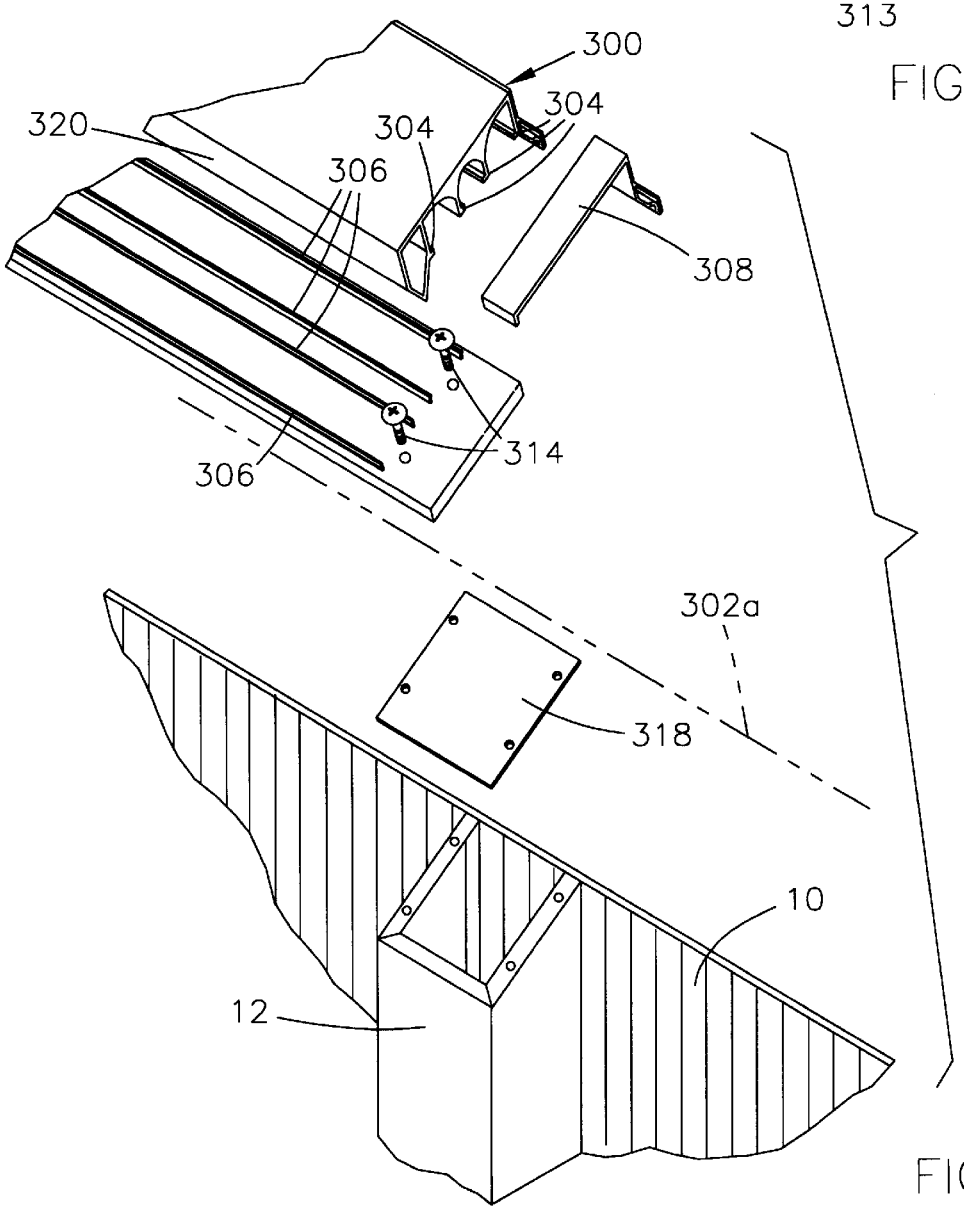
FIG. 7 is an exploded perspective view of the pool decking system of FIG. 6.

FIGS. 6 and 7 are more detailed views of a decking system in accordance with a preferred embodiment of this invention. FIG. 6 shows a platform 300 with an extension 320, with the platform 300 being assembled to a combination top rail and mounting channel (rail-channel) 302. The rail-channel 302 is a modified top rail (e.g., rail 14 in FIGS. 1 through 3) that includes prongs 306 for engaging shoulders 304 formed on the bottom of the platform 300. The shoulders 304 are preferably tapered ("wedged") to resist movement of the shoulders 304 relative to the rail-channel 302. The platform 300 also includes a second extension 310 that conceals the joint between the platform 300 and the rail-channel 302. The second extension 310 also includes a channel 312 that can be used in combination with a tube or cord 316 that fits into the channel 312 with an interference fit to retain the edge of the pool cover 313, as shown in FIG. 6. FIG. 7 shows the assembly in exploded perspective with the platform 300 and rail-channel 302 in combination with an end cap 318 that covers the top end of the vertical support 12. Also shown in FIG. 7 is a compensator 308 that is placed between adjacent sections of platform 300 to compensate for joint expansion and to conceal any gaps between the ends of adjacent platforms 300. The ends of adjacent rail-channels 302 preferably cover the end caps 318 and are secured thereto (threaded into the vertical supports 12) with screws 314. Alternatively, the mounting channel could be configured to snap onto the existing top rail, e.g., top rail 14 of FIGS. 1 through 3.

Figure 8:
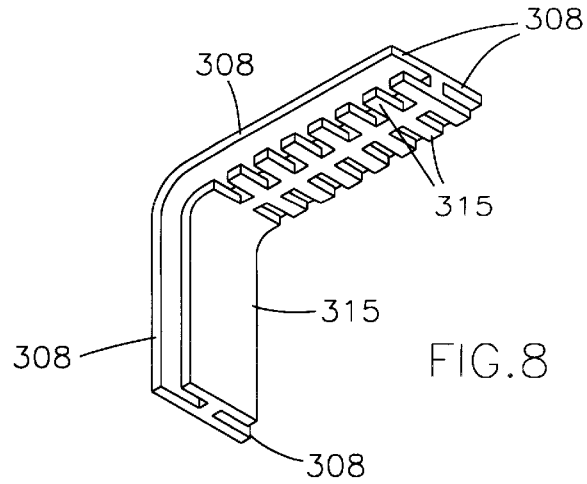
FIG. 8 is a perspective view of a joint expansion compensator in accordance with a preferred embodiment of this invention.

FIG. 8 is a perspective view of a preferred configuration for the compensator 308 of FIG. 7. Retention of the compensator 308 relies on a segmented flange 315 that slips beneath the lip of the platform 300. As an alternative to the flange 315, the compensator 308 could be equipped with protrusions that snap into mating apertures in the ends of the platforms 300. The compensators 308 may be configured to either fit between and over straight joints between adjacent platforms 300, or between and over angled joints between adjacent platforms 300.

Figure 9:
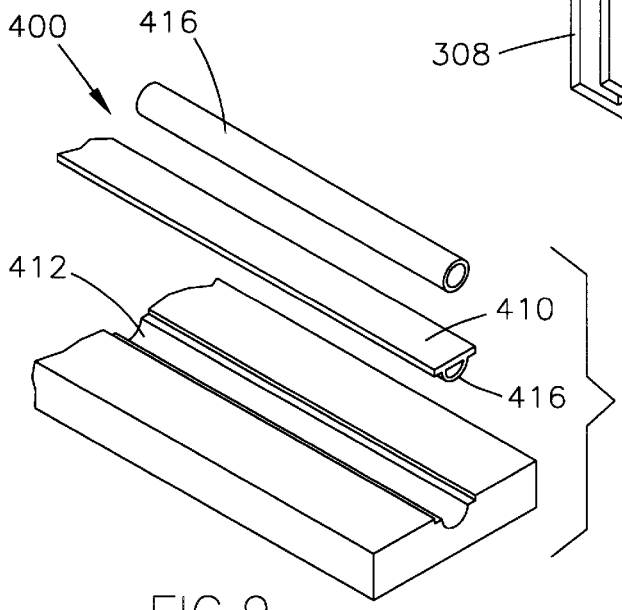
FIGS. 9 and 10 show embodiments for securing a pool cover directly to alternative platforms of this invention.
Figure 10:
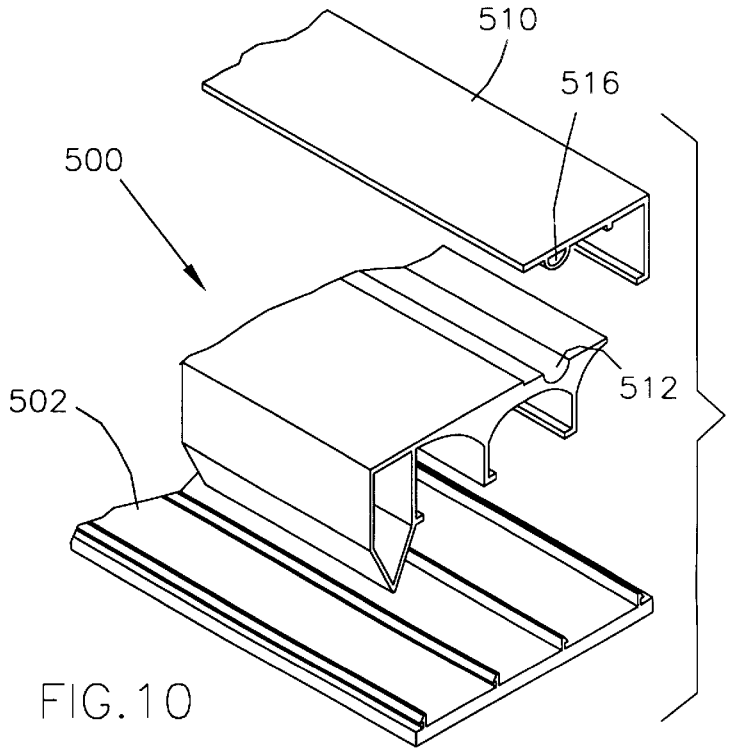

FIGS. 9 and 10 show platform assemblies 400 and 500 modified to include snap-on attachments 410 and 510, respectively, that eliminate the requirement for the cord 316 shown in FIG. 6. The platform assemblies 400 and 500 include a channel 412 and 512, respectively, while the attachments 410 and 510 include an integrally-formed protrusion 416 and 516 that fits into the channel 412 and 515, respectively. An interference fit exists when the edge of a pool cover (313 in FIG. 6) is between the protrusion 416/516 and channel 412/512.

While the invention has been described in terms of a preferred embodiment, it is apparent that other forms could be adopted by one skilled in the art. For example, the cross-sectional configurations of the platforms (e.g., 300), extensions (e.g., 320), rail-channels (e.g., 302) and compensators (e.g., 308) could differ from those shown, Accordingly, the scope of the invention is to be limited only by the following claims.

What is claimed is:

1. A decking system for an aboveground pool having a wall with an upper edge, and a deck surrounding the upper edge of the wall so as to create a gap therebetween, the decking system comprising:

a platform configured for mounting to and over the upper edge of the wall, the platform having an upper surface, an oppositely-disposed lower surface, an inner edge and an oppositely-disposed outer edge configured for placement over the gap between the deck and the upper edge of the wall; and an extension that extends downward from the lower surface of the platform at the outer edge of the platform, the extension being configured to extend downward into and fill the gap between the deck and the upper edge of the wall when the platform is mounted to the upper edge of the wall, such that the platform and the extension create a smooth, level and substantially gap-free transition from the deck to the pool;

wherein removal of the platform from the upper edge of the wall exposes the gap to allow access between the deck and the wall.

2. A decking system according to claim 1, wherein the aboveground pool has a top rail secured to the upper edge of the wall, the top rail defining the gap with the deck, the platform being configured to be removably attached to the top rail so as to permit re-exposure of the gap between the top rail and deck.

3. A decking system according to claim 1, wherein the platform comprises a second extension at the inner edge of the platform, the second extension having means for retaining an edge of a pool cover.

4. A decking system according to claim 1, further comprising a mounting rail configured for securement to the upper edge of the wall, the mounting rail having means for securing the platform thereto.

5. A decking system according to claim 4, wherein the platform comprises a second extension at the inner edge of the platform, the second extension concealing a joint between the platform and the mounting rail when the platform is secured thereto.

6. A decking system according to claim 5, wherein the second extension has a channel for retaining an edge of a pool cover.

7. A decking system according to claim 1, further comprising a joint expansion compensator configured for securement between an adjacent pair of the platform so as to fill any gap between the adjacent pair.

8. A decking system according to claim 1, wherein the extension has a triangular cross-sectional shape.

9. A decking system according to claim 1, further comprising a channel in the platform and a snap-on attachment for securing an edge of a pool cover within the channel.

10. A decking system according to claim 1, further comprising a mounting rail secured to the upper edge of the wall, the mounting rail defining the gap with the deck, the platform being releasably secured to and over the mounting rail, the extension extending downward into and filling the gap between the mounting rail and the deck.

11. A decking system according to claim 10, wherein the extension is sufficiently sized to fill the gap between the deck and the mounting rail and the gap is sufficiently sized to allow for maintenance and repairs to the pool and installation of a pool cover.

12. A decking system according to claim 10, wherein the deck abuts against the extension and the outer edge of the platform.

13. A decking system according to claim 10, wherein the platform comprises a second extension at the inner edge of the platform, the second extension having means for retaining an edge of a pool cover.

14. A decking system according to claim 10, wherein the mounting rail has prongs releasably securing the platform thereto.

15. A decking system according to claim 10, wherein the platform comprises a second extension at the inner edge of the platform, the second extension concealing a joint between the platform and the mounting rail.

16. A decking system according to claim 15, wherein the second extension has a channel for retaining an edge of a pool cover.

17. A decking system according to claim 10, wherein a plurality of mounting rails are mounted and secured to the upper edge of the wall, and wherein a plurality of platforms are mounted and secured to the mounting rails, the decking system further comprising a joint expansion compensator configured for securement between an adjacent pair of the platform so as to fill any gap between the adjacent pair.

18. A decking system according to claim 10, wherein the extension has a triangular cross-sectional shape.

19. A decking system according to claim 10, further comprising a channel in the platform and a snap-on attachment for securing an edge of a pool cover within the channel.

20. A decking system mounted to an aboveground pool having a wall, with an upper edge, a deck surrounding the upper edge of the wall, and a pool cover, the decking system comprising:

mounting rails secured to the upper edge of the wall so as to create a gap with the deck, each of the mounting rails having releasable securement means;

platforms mounted to and over the mounting rails with the releasable securement means of the mounting rails, each of the platforms having an upper surface, an oppositely-disposed lower surface having complementary means for engaging the securement means of the mounting rails, an inner edge and an oppositely-disposed outer edge cantilevered over the gap between the deck and the upper edge of the wall;

an extension that is integrally formed with and extends downward from the lower surface of the platform at the outer edge of each of the platforms, each of the extensions extending downward into and filling the gap between the mounting rail and the deck, such that the upper surfaces of the platforms and the extensions create a smooth, level and substantially gap-free transition from the deck to the pool;

a second extension at the inner edge of each of the platforms, the second extensions concealing joints between the platforms and the mounting rails, at least some of the second extensions having means for retaining an edge of a pool cover; and joint expansion compensators between adjacent pairs of the platforms;

wherein removal of any one of the platforms from a corresponding one of the mounting rails exposes the gap to allow access between the deck and the wall.

* * * * *